US005775966A

United States Patent [19]

Bautista Real et al.

[11] Patent Number: 5,775,966

[45] Date of Patent: Jul. 7, 1998

[54] LIFE-SAVING DEVICE WITH LAUNCHER

[76] Inventors: Josep Antoni Bautista Real; Rosa Maria Soriano Colomina, both of c/. Ferrandiz y Belles 4, 1°1ª-17004-Girona, Spain

[21] Appl. No.: 776,460

[22] PCT Filed: Mar. 1, 1996

[86] PCT No.: PCT/ES96/00043

§ 371 Date: Jan. 15, 1997

§ 102(e) Date: Jan. 15, 1997

[87] PCT Pub. No.: WO96/36530

PCT Pub. Date: Nov. 21, 1996

[30] Foreign Application Priority Data

May 17, 1995 [ES] Spain ..... 9500996

[51] Int. Cl.[6] ..... B63C 9/00

[52] U.S. Cl. ..... 441/80; 441/85; 441/94

[58] Field of Search ..... 441/1, 80, 84, 441/85, 88, 90, 91, 92, 93, 94, 96

[56] References Cited

U.S. PATENT DOCUMENTS

| | | | |
|---|---|---|---|
| 1,585,695 | 5/1926 | Schroeder . | |
| 2,945,506 | 7/1960 | Svensson . | |
| 3,070,818 | 1/1963 | Fairchild . | |
| 3,496,580 | 2/1970 | Gulmon . | |
| 3,693,202 | 9/1972 | Ohtani . | |
| 3,886,612 | 6/1975 | Schnirel et al. | 441/85 |
| 4,799,906 | 1/1989 | Perkins | 441/85 |

FOREIGN PATENT DOCUMENTS

| | | |
|---|---|---|
| 837145 | 6/1960 | United Kingdom . |
| 903198 | 8/1962 | United Kingdom . |
| WO 92 05071 | 4/1992 | WIPO . |

*Primary Examiner*—Stephen Avila
*Attorney, Agent, or Firm*—Lackenbach Siegel Marzullo Aronson & Greenspan, P.C.

[57] ABSTRACT

The object of the invention is a life-saving device with launcher which provides for the automatic inflation of the float by simply acting on a lever. The mechanism is comprised of a gas tank or similar integral at its top portion with the float so that said tank is traversed by a hollow cut-off cock whose lower end projects from the container or tank and is terminated by the lever, the upper end being introduced inside the float and the gas penetrating through the hollow tube of said cock. Integral with the assembly is provided a ring which is connected to the rolled-up cable which is itself integral with the launcher, the latter being provided with a gun wherein is introduced the life-saving assembly in order to launch it to a major distance.

6 Claims, 4 Drawing Sheets

LIFE-SAVING DEVICE WITH LAUNCHER

DESCRIPTION

The patent of invention proposed in this specification relates to a LIFE-SAVING DEVICE WITH LAUNCHER which substantially improves the state of the art over what was known and used heretofore.

Briefly speaking, this patent of invention concentrates on an automatically inflatable pliable life-saving device complete with a second device enabling the lifebelt as such to be launched over a substantial distance.

There are substantial hazards involved in the practising of water sports, ascribable to either the recklessness of whose who practise such sports, poor weather conditions, the state of the sea or any other contingency which may result in an accident. If an accident should ensue, clearly placing the casualty's life at stake, prompt action is vital and requires having means of guaranteed or assured effectiveness. Teams of specialised lifeguards are now regularly available at beaches and similar areas, but the means they have are still limited and sometimes ineffective. For instance, lifebelts cannot be used in heavy seas and with a strong head wind, for they cannot be placed within reach of the casualty.

This patent of invention proposes solving such problems specifically by means of an automatically inflatable, reusable, rechargeable, compact small pliable lifebelt.

This lifebelt consists of two main distinct parts which altogether make up a global life-saving system: the life-saving float as such and the device that enables it to be launched over a substantial distance.

The lifebelt, i.e. the float as such, is made of a rubber or similar structure, and is provided on its underside with a small box or container having a gas tank, which gas is released and flows until the lifebelt is inflated.

The lifebelt may be manually or automatically inflated. In the first case, it is sufficient to turn and push the lever attached to the container all the way in order to set a chain mechanism going to release the gas. In the second case, especially applicable wherever the lifebelt cannot be placed within reach of the casualty upon a simple thrust of the hand, a launcher is also used which is connected to the lifebelt through a coupling system.

For an easier understanding of the invention herein set forth a number of drawings are attached by way of example which should at no event to be construed in a limiting or restrictive manner.

Figure 1:
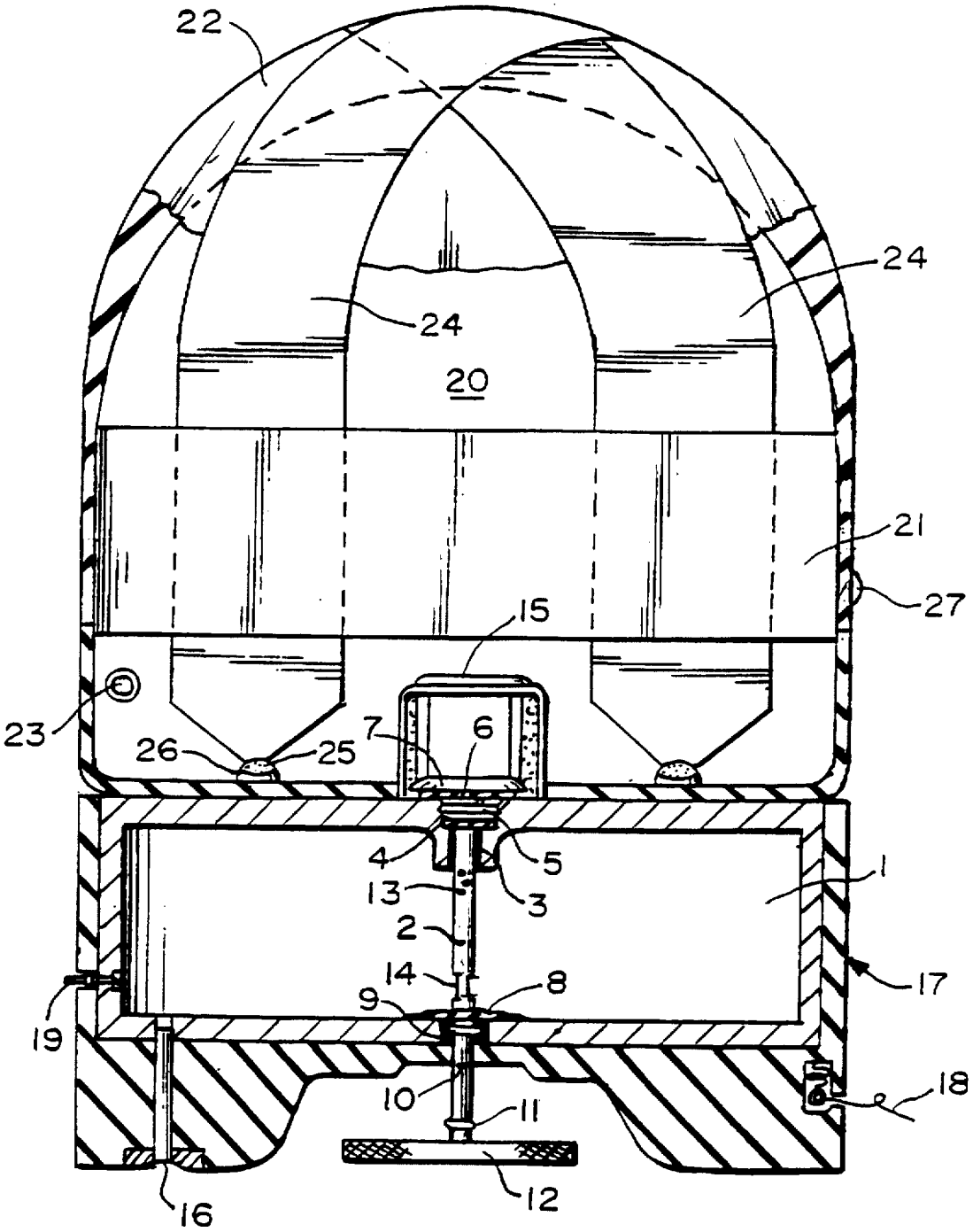

FIG. 1.—A plan view of the Life-Saving Device.

Figure 2:
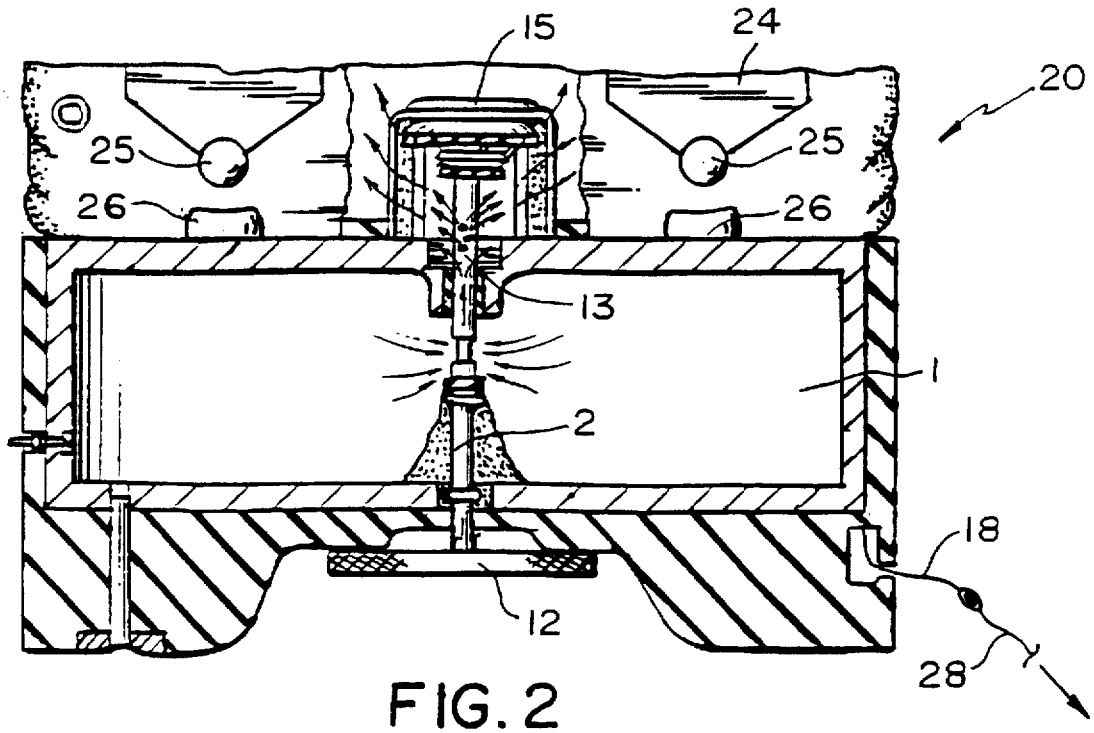

FIG. 2.—A partial plan view of the activated Life-Saving Device.

Figure 3:
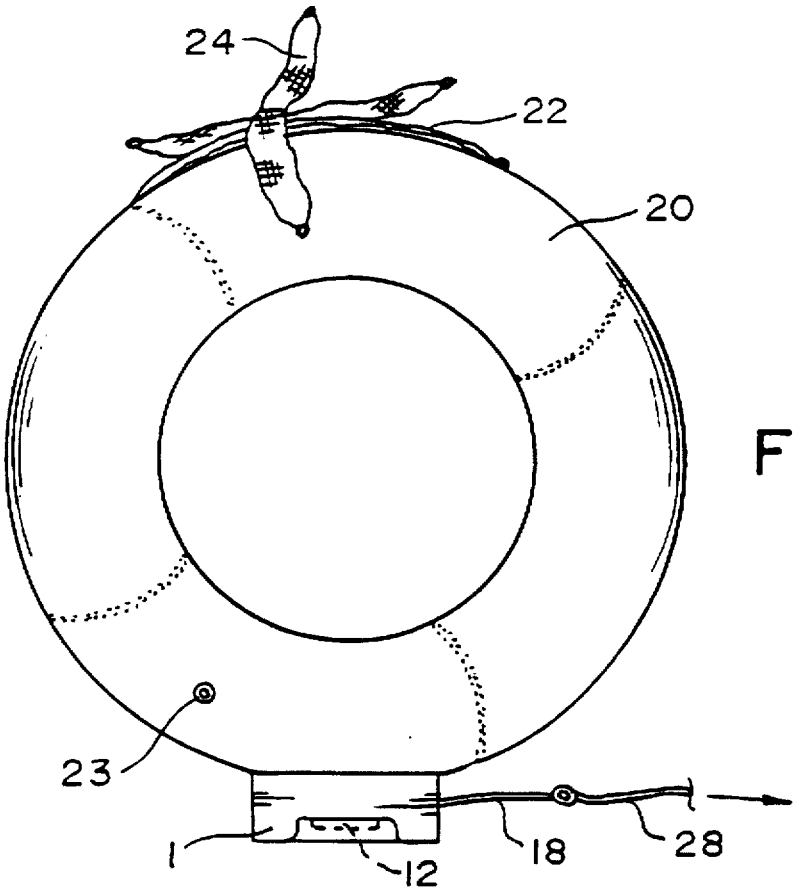

FIG. 3.—A view of the inflated Life-Saving Device.

Figure 4:
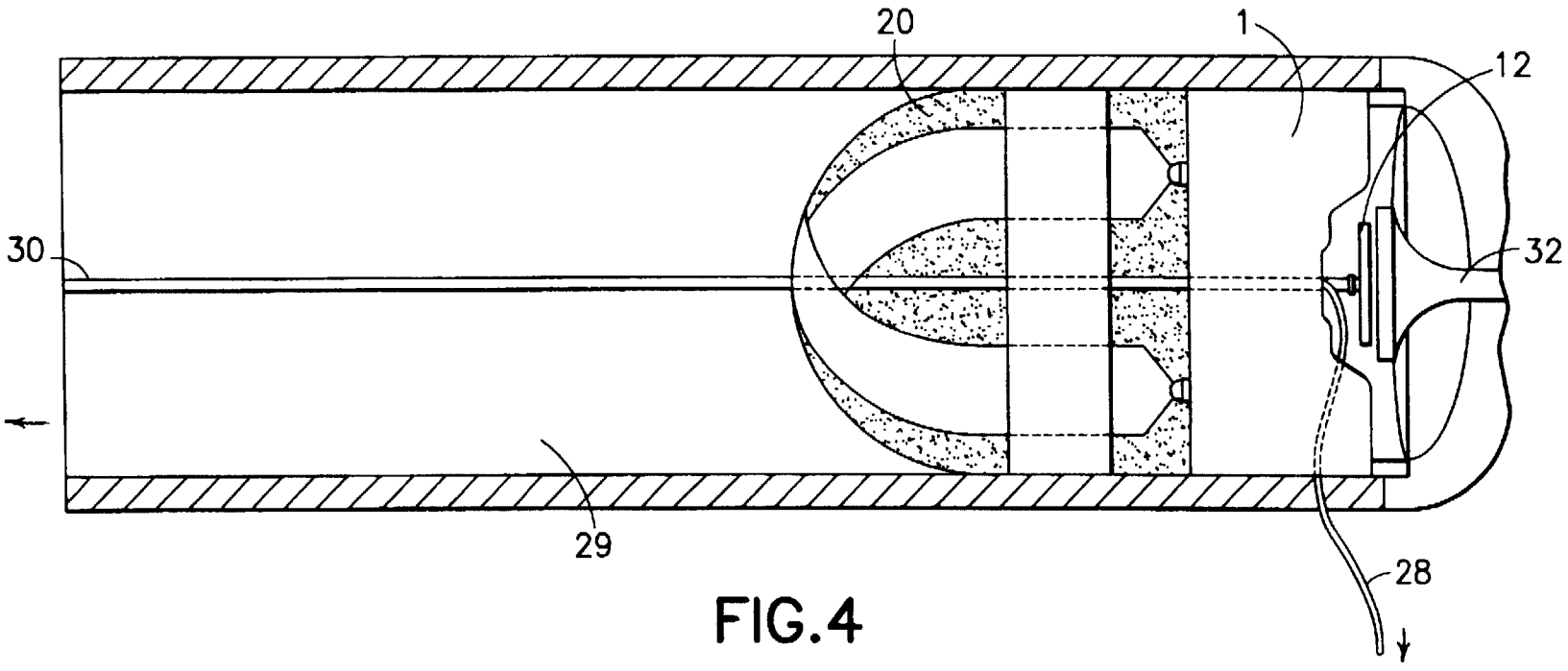

FIG. 4.—A partial plan view of the launching gun.

Figure 5:
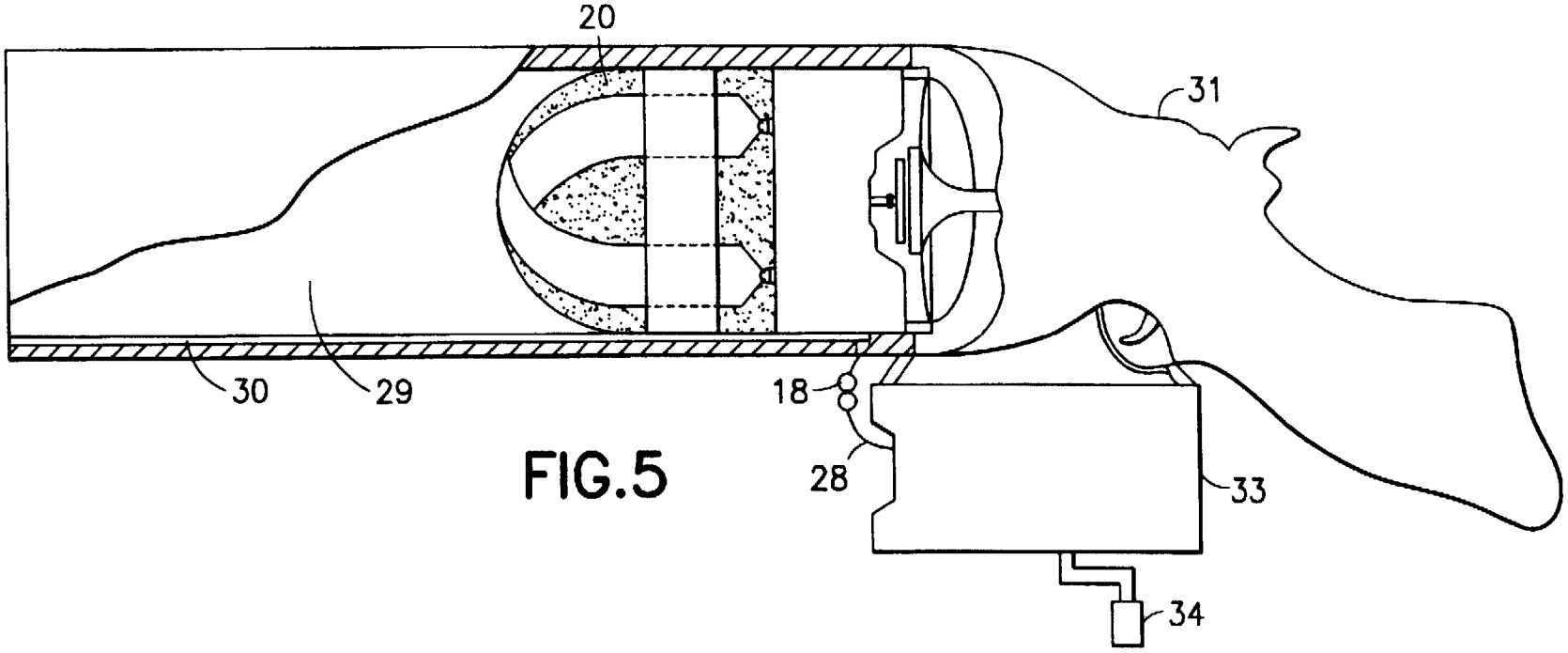

FIG. 5.—A cross-section of the launcher.

As noted hereinabove, two distinct parts may be made to stand out in the Life-Saving Device, namely the lifebelt as such and the ingress and inflating system. As shown in FIG. 1, the ingress and inflating system consists of a small strong cylindrical metallic box (1) traversed crosswise by a cut-off cock (2) the top end of which has a sealing rubber duct (3), a rubber washer (4), a thick thread (5) and a final lid-like top (7) also supported on a rubber washer (6) that is larger than the previous washer albeit slightly less so than the lid. The bottom of said cut-off cock (2) has a rubber membrane (8) with its ends perfectly stuck to the base of the box with a hole in the middle for the cut-off cock (2) to be inserted and then left solidly attached, albeit with mobility and elastic capacity, these two elements, namely the membrane (8) and the cut-off cock (2), in this part of the item, having an appearance that resembles the outer base of a car gear change lever. Another piece of sealing rubber (9) likewise tube-shaped and with a large angle-shaped notching or rebate is provided below this area. A stop mark (10) is then provided followed by a rubber stop (11) which will fit tightly and snugly within the angle rebate aforesaid of the sealing rubber (9). The outer part is the base or lever (12) of the cut-off cock (2), made of a metallic or impact-resisting material. The ends of the cut-off cock 2) have distinct and important characteristics. The bottom is hollow whereas the top has holes or pores (13) of very small gauge at two diametrically opposed areas. Furthermore, the bottom has two rebate-shaped similarly opposed openings (14). Rods having a metallic connecting or cover plate (15) are finally provided integral with the top of the box or container, right above the line of the cut-off cock (2), said plate serving as a stop for the cut-off cock.

A conventional feed duct and valve (16) is provided at one end of the bottom of the device for a compressed air or gas receptacle. The sides of the metallic box are protected with a layer of rubber (17) and so is its considerably thicker bottom, which forms a protective recess along the entire range of the cut-off cock. On one side, within a small recess formed by the same rubber (17), a small ring is housed integral with a plasticised steel wire cable (18) of little thickness, the latter being in turn integral with the rest of the assembly or housing. A manual pressure indicator (19) is housed on the other side of the device, serving to inform of the existing pressure, to which end it need only be pressed with a finger and checked to see whether it retrieves its initial position.

The same FIG. 1 shows details of part of the float, which consists of a life-saving float (20) with an outer section in the form of a small secant line (if and when inflated) with the same size as the top of the metallic box (1), and thus this end of the float (20) and the top of the box (1) are fully and sealingly integral with each other. The float is folded at this area of the device in the form of bellows or an accordion (not as a sheet). The other diametric end of the float (20) is integral with a concave half-oval rubber (22) which would in turn wrap the entire folded float, as a hood or bathing cap. A (conventional) one-way emergency blower (23) is also included. Three nylon or any other strong light material ribbons are finally provided: two are downwardly directed across the hood from side to side, are connected at the top (24) and end in rubber balls or tassels (25) that are in turn inserted in cavities of the same material (26), and a third transverse ribbon (21), also integral at one end, is arranged halfway up the hood, thereby to surround the same and be fitted as a nail or rubber stop within a small hole (27) in the hood. These three ribbons complete the picture of this part of the item, and the assembly thus obtained is aerodynamic and compact.

The operation of this device is very simple, as detailed in FIG. 2. The lever (12) of the cut-off cock (2) need only be turned to release the cock from the thread end (5). Then, a slight pressure on such lever (12) causes the whole of the hollow tube assembly inside the box to move up until it abuts against the metallic plate stop (15). This will moreover prevent a casualty, panic-stricken as is the rule in these cases, from causing the mechanism to retrieve its previous position by hitting or hugging it in desperation. The rebate openings (14) remain within the receptacle, whereas the small pores on the top (13) communicate with the outside of the box or container (1), i.e. with the inside of the lifebelt (20). The difference in pressure and the need of the gas or compressed air to expand creates a passage for the gas to flow from its tank in the box (1) into the float (20), which shall have been folded until then. The gas acts to gradually inflate the float, pushing the nylon ribbons or strips which are released from their fastenings (25) and (27). The hood (22) will gradually rise and draw diametrically away from the box, these two elements, viz. the box and the hood, finally becoming the ends of the inflated float, as shown in detail in FIG. 3.

When the distance at which the casualty lies is very large, and manual launching cannot be resorted to, this Life-Saving Device is fitted with an element that allows it to be launched, automatically inflating the float. FIG. 2 shows in detail the position of the safety ring (18), housed within a recess in the rubber and connected to a cable that is in turn integral with the rest of the device. As shown in detail in FIG. 4, said ring is connected to the roll-up cable (28) of the launcher. The lever (12) then turns to be released from the thread (5) without there being any risk of leakage because of the sealing finish of the assembly. The integral float (20) and container (1) are inserted within the gun (29), bottom first, bringing the cable into register with the longitudinal groove or notch (30) along the gun (29), and are then dropped inside the same until they abut against the stops at the bottom inner end of the launcher (31) gun, preventing any contact whatsoever between the lever (12) and any other element of the ejecting mechanism. The cable exits at a height near to the percussion mechanism. Once the shot is calculated and the trigger is pressed, the ejecting mechanism acts on a cylinder ending in a cone shape with concave sides (32), and having a flat base and a diameter that is slightly greater than that of the lever (12), whereupon said cylinder (32) pushes the lever (12) causing the float inflating process to begin, and thus when the trigger is pressed to propel the float, the latter begins the inflating process which ends when in the water. As shown in FIG. 5, said cable (28) is integral with a roll stand (33) and thus in order to make a rescue once the casually is physically in contact with the float (20), the lever (34) with which the cable roll stand (33) is fitted, and which works one-way, much like a bicycle wheel sprocket, need only be driven. It should importantly be noted that the cable stand is dismountable and may hence be detached from the rest of the launcher, thereby facilitating retrieval of the cable and of the casualty at issue. Once the life-saving device has been retrieved, the entire assembly need only be folded to be ready to be used again, fastening the strips (25) and (27), reinstating the thread (5) and recharging air or gas (16).

Phosphorescent materials should advisably although not necessarily be used to make this life-saving device, or at least the fastening ribbons and the plasticised drag cable for an easier location thereof in poor visibility conditions. Due to the design, the air or gas contained in the tank is highly protected and there are therefore absolutely no chances of leakage due to the safety of the seals. There is very little maintenance which consists merely of regular safety checks. Its small size moreover allows it to be easily carried and stored.

The patent of invention herein proposed can, within its essence, be otherwise embodied in practice, with varying materials and sizes, which shall also be covered by the protection applied for herein and which will at no event alter the spirit of the claims.

We claim:

1. A compact, reusable and launchable life-saving device generally of "missile" shape and having a replenishable/replaceable pressurized gas tank, comprising:

an inflatable life preserver which when inflated having generally the shape of a donut, a housing/container (1) forming said gas tank, and having a translatable, gas control element (2) extending through said housing/container from a first side to a second side thereof, and said gas control element having inlet (14) and outlet (13) means adjacent opposite ends of a gas passageway extending therebetween;

said inflatable life preserver and said housing/container being sealingly affixed to each other, with the end of said gas passageway containing said outlet means extendible into said inflatable life preserver via a "cup-like" entry section having a stop, forming a part of said preserver, for limiting the translatable movement of said gas control element when activated to release said gas in said housing/container; wherein said life-saving device may be manually inflated as desired to any degree or fully inflated when launched by means of a launching gun.

2. The compact, reusable and launchable life-saving device according to claim 1, further including a lever element (12) at the opposite end of said control element (2) for manual activation or by a launching gun.

3. The compact, reusable and launchable life-saving device according to claim 1, further including wire/cable means (18) mutually cooperatively associated with a launching gun for maintaining contact with said life preserver when launched.

4. The compact, reusable and launchable life-saving device according to claim 1, wherein said housing/container is equipped with a connection/valve (16) for filling same with said gas from an external gas source.

5. The compact, reusable and launchable life-saving device according to claim 1, wherein said life preserver is formed of a rubber or rubber-like material which is capable of retaining a pressured gas contained therein.

6. The compact, reusable and launchable life-saving device according to claim 4, wherein said like preserver when not in use is folded in the form of a bellow/accordion with a plurality of bands fixed to said life preserver on a side opposite to that side affixed to said housing/container for temporarily holding said folded form/shape when said life preserver is not used, but for releasing same when said life preserver is activated or launched.

* * * * *